US005311725A

United States Patent [19]

Martin et al.

[11] Patent Number: 5,311,725

[45] Date of Patent: May 17, 1994

[54] STRETCH WRAPPING WITH TENSION CONTROL

[75] Inventors: Stuart Martin, Corydon, Ind.; Jim Lancaster; John Fain, both of Louisville, Ky.

[73] Assignee: Lantech, Inc., Louisville, Ky.

[21] Appl. No.: 921,663

[22] Filed: Jul. 30, 1992

[51] Int. Cl.[5] ..... B65B 13/12

[52] U.S. Cl. ..... 53/556; 53/588

[58] Field of Search ..... 53/399, 441, 556, 588

[56] References Cited

U.S. PATENT DOCUMENTS

| | | | |
|---|---|---|---|
| 4,050,220 | 9/1977 | Lancaster et al. | 53/556 |
| 4,178,734 | 12/1979 | Lancaster et al. | 53/399 |
| 4,302,920 | 12/1981 | Lancaster et al. | 53/399 |
| 4,317,322 | 3/1982 | Lancaster et al. | 53/399 |
| 4,524,568 | 6/1985 | Lancaster et al. | 53/588 X |
| 4,553,374 | 11/1985 | Lancaster et al. | 53/588 X |
| 4,676,048 | 6/1987 | Lancaster et al. | 53/399 |
| 4,706,443 | 11/1987 | Humphrey | 53/556 |
| 4,712,354 | 12/1987 | Lancaster et al. | 53/399 |
| 4,866,909 | 9/1989 | Lancaster et al. | 53/399 |
| 4,979,358 | 12/1990 | Keip | 53/588 X |

FOREIGN PATENT DOCUMENTS

| | | | |
|---|---|---|---|
| 220712 | 5/1987 | European Pat. Off. | 53/556 |
| 246659 | 11/1987 | European Pat. Off. | 53/441 |
| 3634924 | 4/1988 | Fed. Rep. of Germany | 53/556 |
| 2107668 | 5/1983 | United Kingdom | 53/556 |

*Primary Examiner*—John Sipos
*Assistant Examiner*—Daniel Moon
*Attorney, Agent, or Firm*—Finnegan, Henderson, Farabow, Garrett & Dunner

[57] ABSTRACT

A stretch wrap packaging machine includes a support frame and a rotatable frame rotatably mounted on the support frame. A dispenser is mounted on the rotatable frame to follow an orbital path. The dispenser has a web tensioning system which is selectably operable in a plurality of states. At least one actuation ring is moveably mounted on the support frame for cooperation with the tensioning system and selectively rendering the tensioning system operable in each of the plurality of states of operation throughout the orbital path. An activator moves the actuation ring to cooperate with the tensioning system. The tensioning system may include prestretch rollers connected by an engageable clutch. The tensioning system may also include at least one power assisted roller which is connected by a clutch to a power source.

20 Claims, 7 Drawing Sheets

STRETCH WRAPPING WITH TENSION CONTROL

BACKGROUND OF THE INVENTION

The invention relates to stretch wrapping a load with packaging material and more particularly to controlling the tension of the packaging material during the wrapping process.

Stretch wrapping devices have been used to wrap a web of tensioned packaging material around the outside of a load by providing relative rotation between the load and a packaging material dispenser. In some instances, the dispenser includes prestretch rollers which rotate at different speeds to stretch the web before it is wrapped on the load, and a dancer roller which is used to help control the dispensing of the film and sense a film web break to stop the dispensing of the film.

The stretch wrapping process begins by loading a roll of stretch wrap packaging material, such as a stretch wrap film web, in the dispenser. After loading the roll, the leading end of the film web is threaded through the prestretch rollers and around the dancer roller and then secured to the load or to a clamp.

The tension in the film web between the web dispenser and the load can be provided in many different ways. For example, it can be provided by a brake which restrains film roll as the web is dispensed. It also can be provided by a roller between the film roll and the load which is connected to a brake. It further can be provided by a prestretch mechanism which, in addition to prestretching the film, restrains the film between the dispenser and the load to tension the web.

The tension imported to the film web by the prestretch mechanism can be provided solely by a mechanical interconnection between the upstream and downstream prestretch rollers. The tension also can be provided, regulated or reduced by a speed or torque control which uses an external power source to control the speed or torque of the prestretch rollers. Examples of such arrangements are shown in U.S. Pat. Nos. 4,302,920, 4,418,510, 4,387,548, and 4,866,909 which are incorporated herein by reference.

In a number of instances, it is desirable to disengage the mechanical linkage between the prestretch rollers or disengage the prestretch rollers from the external power source. For example, it is useful when the web is threaded through the prestretch rollers.

In some instances, such as with unstable loads, it may be desirable to dispense the first circumferential wrap of the web around the load at substantially less tension in the web than subsequent circumferential wraps around the load. This enables the load to be secured in position before wrapping it with a highly tensioned web which is required to effectively contain the load. Such highly tensioned web would otherwise undesirably permit the load to be displaced if it had not previously been wrapped with the web while at a low tension.

In stretch wrapping operations where the film web dispenser is stationary, it is easy to provide mechanisms to electronically control the components of the film web dispenser because the electronic circuitry between power sources, control mechanisms and the film web dispenser does not cross between two moving units. However, when the film web dispenser is rotated around a load, it is necessary to use commutators to provide electrical communication between components in the film web dispenser and control mechanisms or power sources which do not rotate with the film web dispenser.

Previous attempts to disengage the prestretch rollers or the external power source, or control the tension of the film web in a moving web dispenser have not been found to be completely satisfactory. In some wrapping machines, the mechanical drive between the two prestretch rollers, and the mechanical drive between the prestretch rollers and an external power source previously had been coupled by respective wrap spring clutches. These clutches were engaged and disengaged by a mechanical linkage which included moveable pawls that cooperated with ratchet collars on the clutches.

In one instance, the clutches were engaged and disengaged by a mechanical linkage actuated by a spring loaded dancer roller. So long as the film web pressed on the dancer roller, the clutches would stay engaged. This kept the prestretch rollers engaged and interconnected to prestretch the film web. It also kept the prestretch rollers engaged to an external power source. The power source regulated the tension of the film web between the web dispenser and the load, generally by reducing that tension during normal wrapping operations.

If the film web broke and ceased pressing on the dancer roller, the dancer roller would move because it was spring loaded. Such movement would be transmitted through a linkage to disengage the clutches. This caused the prestretch rollers to mechanically disengage from each other and from the external power source to prevent undesirable consequences such as winding the broken film web around the prestretch rollers. The use of a spring loaded dancer roller to engage and disengage the tensioning system also had the disadvantage of requiring an undesirably high minimal level of tension on the film to restrain the dancer roller against its spring loading during operation.

Another arrangement which mechanically engaged and disengaged clutch mechanisms on the web dispenser used an arm which mechanically reached in to toggle a control mechanism on the orbiting web dispenser at a predetermined point in its orbit. The control mechanism could then be toggled back to reengage the clutch mechanism when the web dispenser again reached that point in its orbit.

Yet another arrangement to engage and disengage clutches included a spring loaded follower roller which extended from the orbiting web dispenser. The follower roller was engageable with the inner radial surface of a curved plate mounted on the support frame of the stretch wrapping apparatus at one segment of the dispenser's orbit. When the plate was radially pivoted into a ramped position, it engaged the spring loaded follower roller and disengaged the clutch mechanisms on the web dispenser. The clutch mechanisms would reengage after the follower roller on the web dispenser passed the plate or the plate was pivoted out of position.

These earlier arrangements had the disadvantage of being unable to use a mechanical device to immediately and flexibly control the tension on the film web.

SUMMARY OF THE INVENTION

It is an object of the invention to allow control of tension of the web, or engagement or disengagement of tensioning mechanisms in the web dispenser, immediately and flexibly during any point of the threading and wrapping process.

It is also an object of the invention that the controlled engagement or disengagement of the tensioning mechanism will work automatically regardless of whether the web dispenser is moving or is temporarily stationary.

It is also an object of the invention to permit disengagement or reduced tension on the web automatically during an emergency stop, a loss of electrical power to the stretch wrapping device, or a loss of air pressure to the stretch wrapping device.

It is also an object of the invention to require a positive act to engage the tensioning mechanism to provide full or normal tension on the film web and to disengage the tensioning mechanism if no signal is being sent.

It is also an object of the invention to provide for reduced tension on the web at the end of the wrapping cycle during wipedown to improve the procedure of wiping the trailing end of the wrapped web onto an underlying layer of web to secure it on the load.

It is also an object of the invention to, provide for reduced tension on the web during the initial portion of the wrapping cycle or another selected portion of the wrapping cycle to prevent the load from being pulled off its support and to prevent the need to use complex stabilization supports or procedures on the size of the load.

It is also an object of the invention to reduce the tension which would otherwise be applied to the film web when the web breaks and eliminate the need for a dancer roller to do so.

It is also an object of the invention to provide for disengagement of the tensioning mechanism during the process of threading the web through the rollers in the dispenser, without taking affirmative action to do so and without needing to use a dancer roller to do so.

BRIEF DESCRIPTION OF THE DRAWINGS

The accompanying drawings, which are incorporated in and constitute part of the specification, illustrate an embodiment of the invention and together with the description, serve to explain the principles of the invention.

DESCRIPTION OF THE PREFERRED EMBODIMENTS

Reference will now be made in detail to the present preferred embodiments of the invention. Examples of the embodiments are illustrated in the accompanied drawings.

In accordance with the present invention, there is provided an apparatus for stretch wrapping a load with a web of packaging material.

Figure 2:
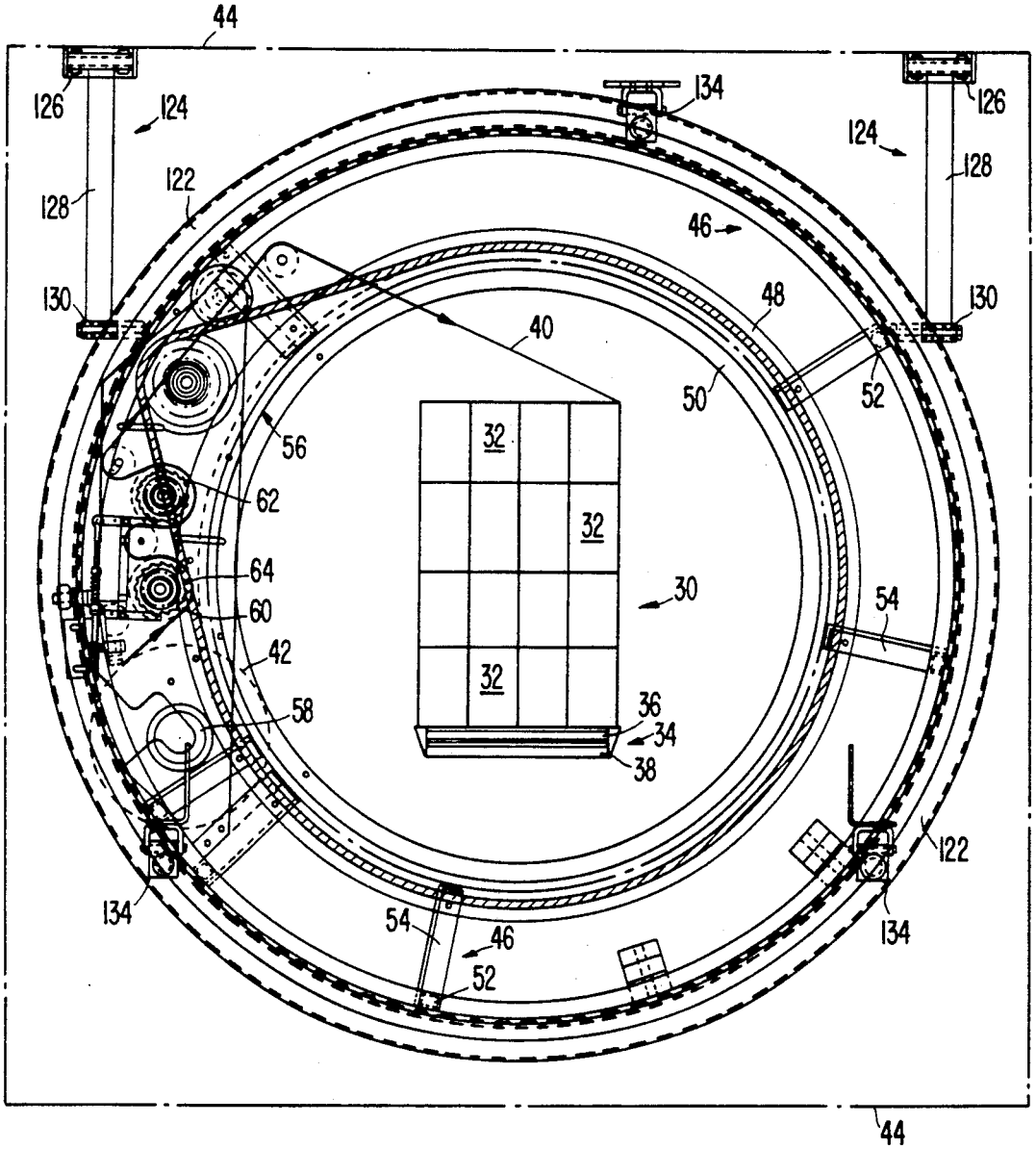
FIG. 2 is an end view of the arrangement shown in FIG. 1.

As shown in FIG. 2, the web of packaging material may include conventional stretch wrap film 40 which is dispensed from a film roll 42. The load 30 may include a number of products 32 which are subcomponents stacked in a rectangular array. The load is conveyed through the wrapping area of the apparatus by a conveyor 34 which includes an upper endless loop conveyor belt 36 and a lower endless loop conveyor belt 38 which respectively convey the load and the wrapped packaging material on their outer surfaces and return along a more central area of the conveyor. A conveyor such as conveyor 34 is disclosed in greater detail and U.S. Pat. No. 4,317,322, which is incorporated herein by reference. Other conveyors may also be used.

Figure 7:
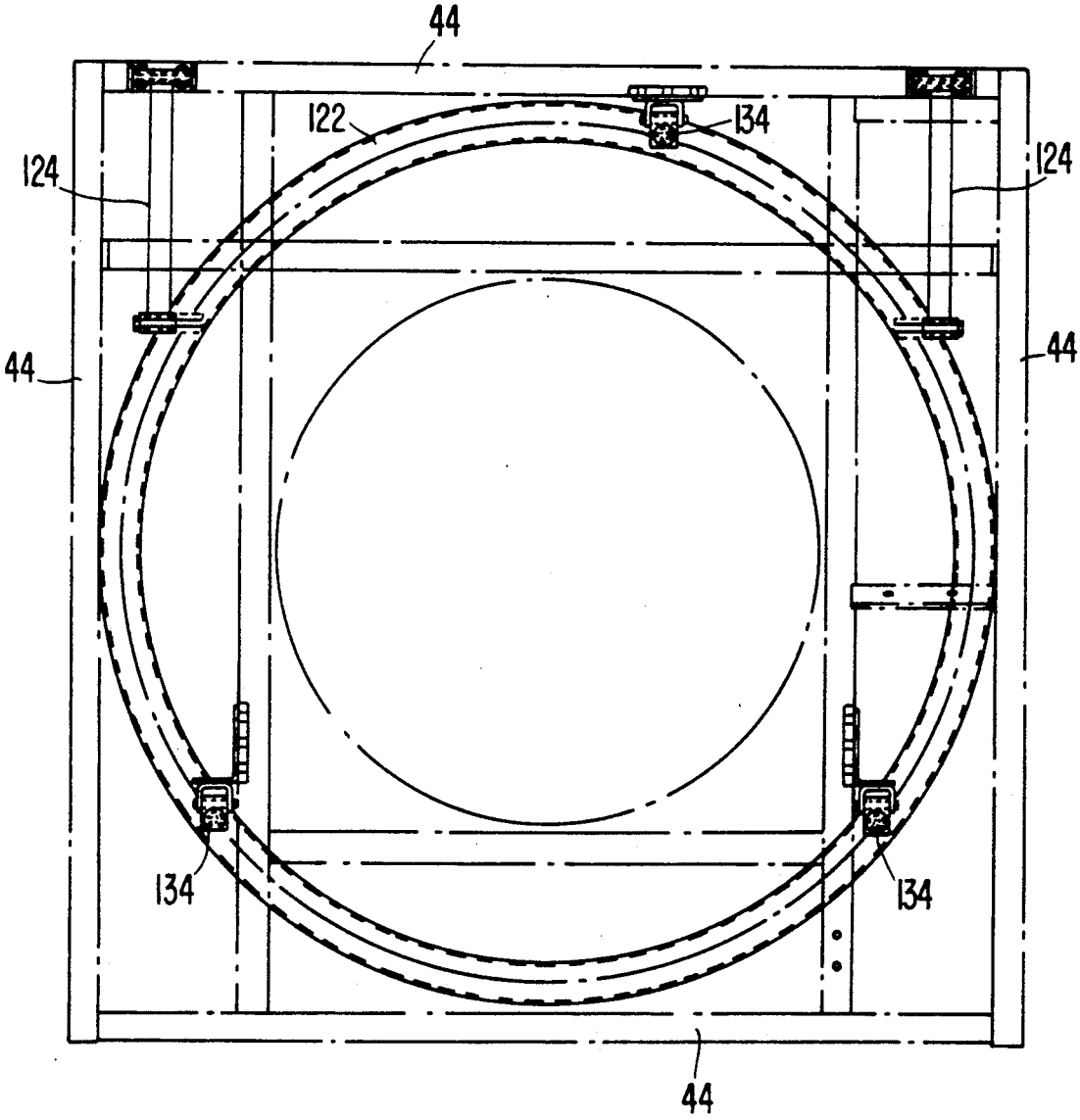
FIG. 7 is an end view of portions of the stretch wrapping machine shown in FIG. 2 and additional portions.
Figure 8:
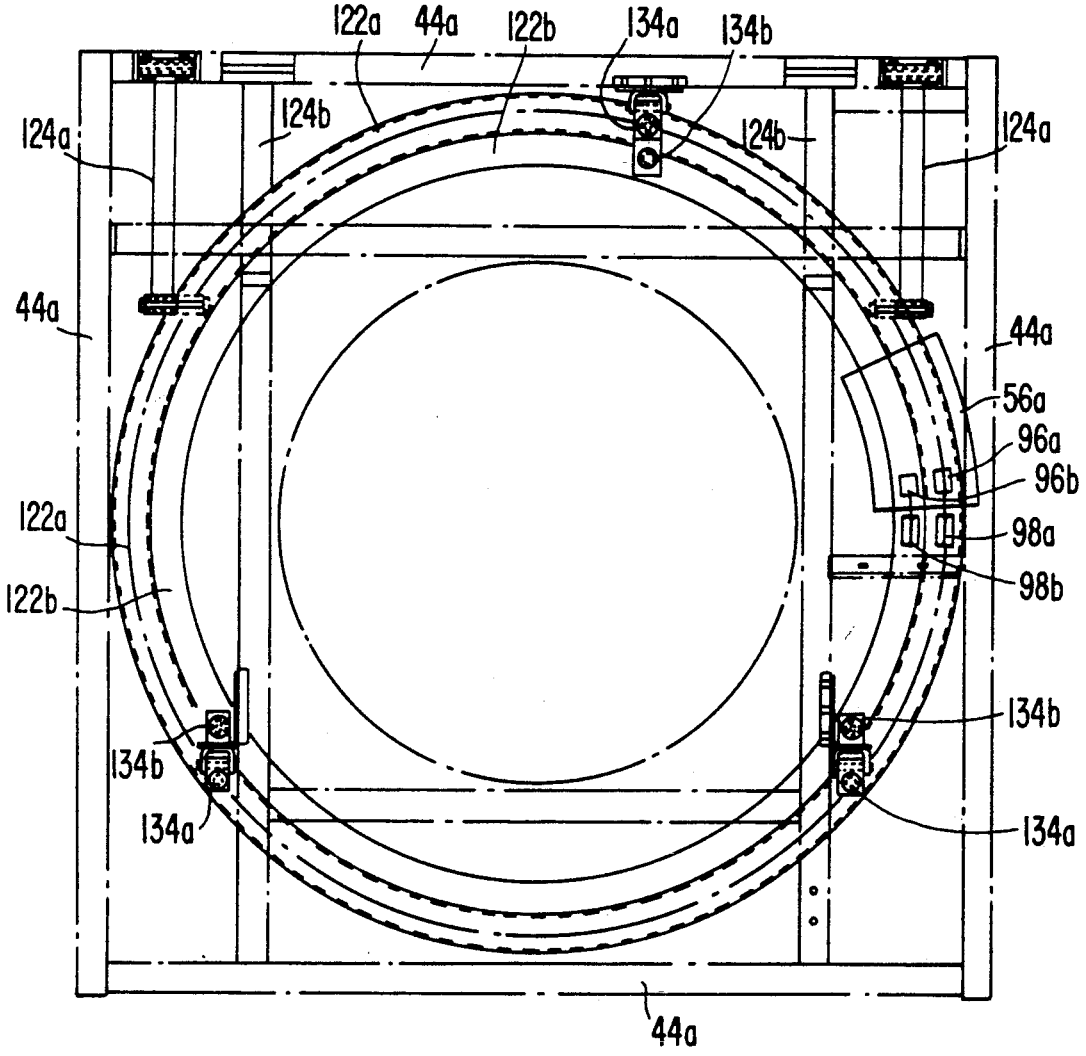
FIG. 8 is an end view of portions of the stretch wrapping machine shown in FIG. 2 and additional portions illustrating a second embodiment incorporating the present invention.

According to the present invention, there is provided a support frame. As shown in FIG. 2, the support frame is designated by numeral 44. More details of an exemplary support frame 44 are shown in FIGS. 7 and 8 where the support frame is shown in broken lines and includes various horizontal and vertical steel beams which are stationary and which support other components of the device. Various supports frames are shown in the patents that are incorporated by reference. The support frame can either constitute a single integral or interconnected support structure or several support structures which are not interconnected.

Figure 1:
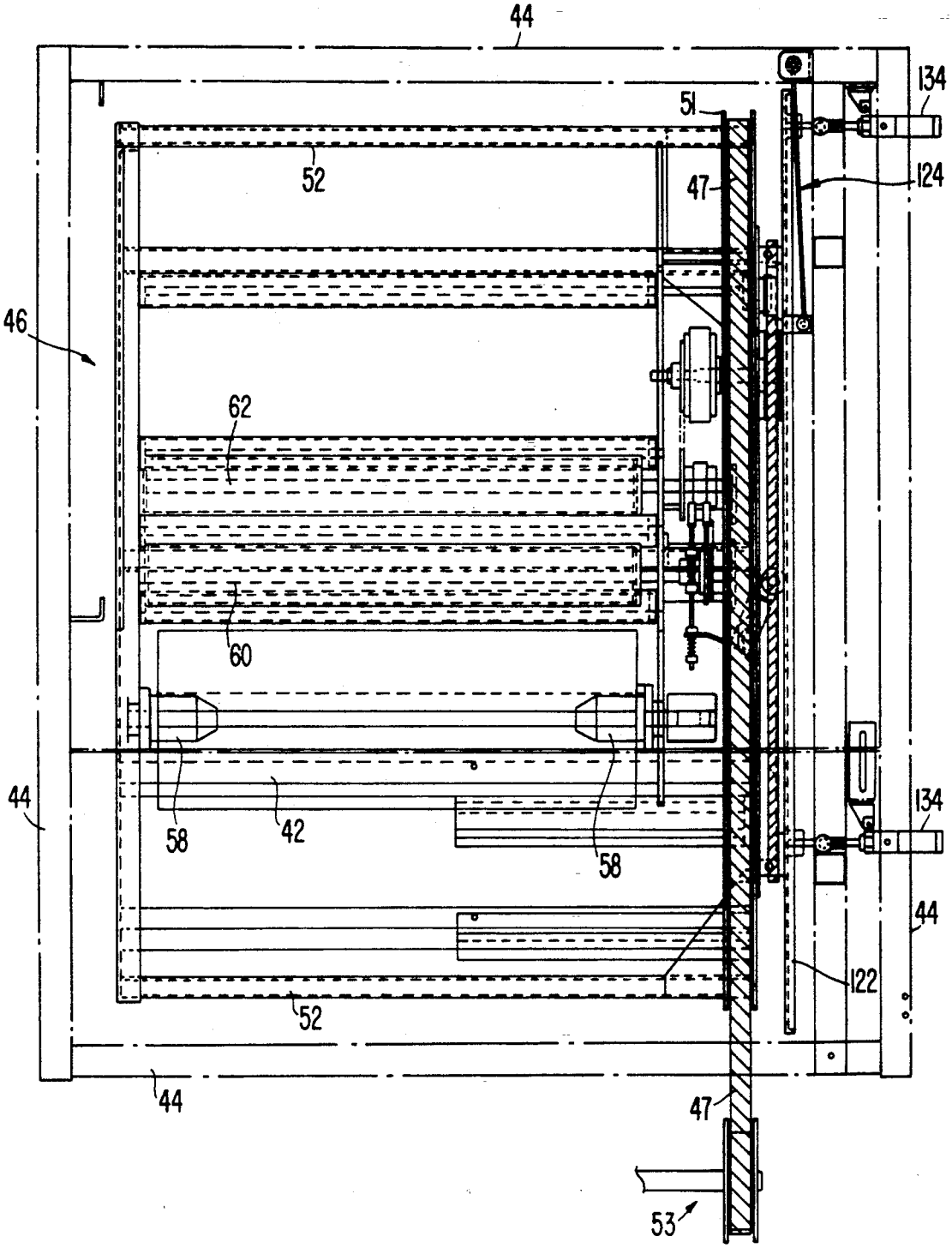
FIG. 1 is a side view of an embodiment of portions of a stretch wrapping, machine incorporating the present invention.

According to the present invention, there is provided a rotatable frame rotatably mounted on the support frame. As shown in FIGS. 1 and 2, the rotatable frame includes a rotatable drum 46 including an outer ring shaped bearing 48 on one end of the drum 46 which is supported by and which rotates relative to an inner ring shaped bearing 50 which is mounted on the support frame 44.

Outer ring shaped bearing 48 is connected to various beams 52 and cross pieces 54 to form the rotatable drum 46. As shown in FIG. 2, rotatable drum 46 is rotated in the counterclockwise direction. As shown in FIG. 1, drive belt 47 passes around a large portion of one of the rings 51 of rotatable drum 46 connected to a conventional electric motor drive 53 which is mounted on frame 44. Operating motor drive 53 rotates drum 46 about its principal axis.

According to the present invention, there is provided a dispenser mounted on the rotatable frame to follow an orbital path. The dispenser has a web tensioning system which is selectably operable in a plurality of states.

As shown in FIGS. 1 and 2, the dispenser includes a roll carriage 56 including mandrels 58 on which film roll 42 is mounted to rotate, and a series of rollers over which film web 40 passes. Some of these rollers form a web tensioning system which controls the tension on the web 40.

Figure 3:
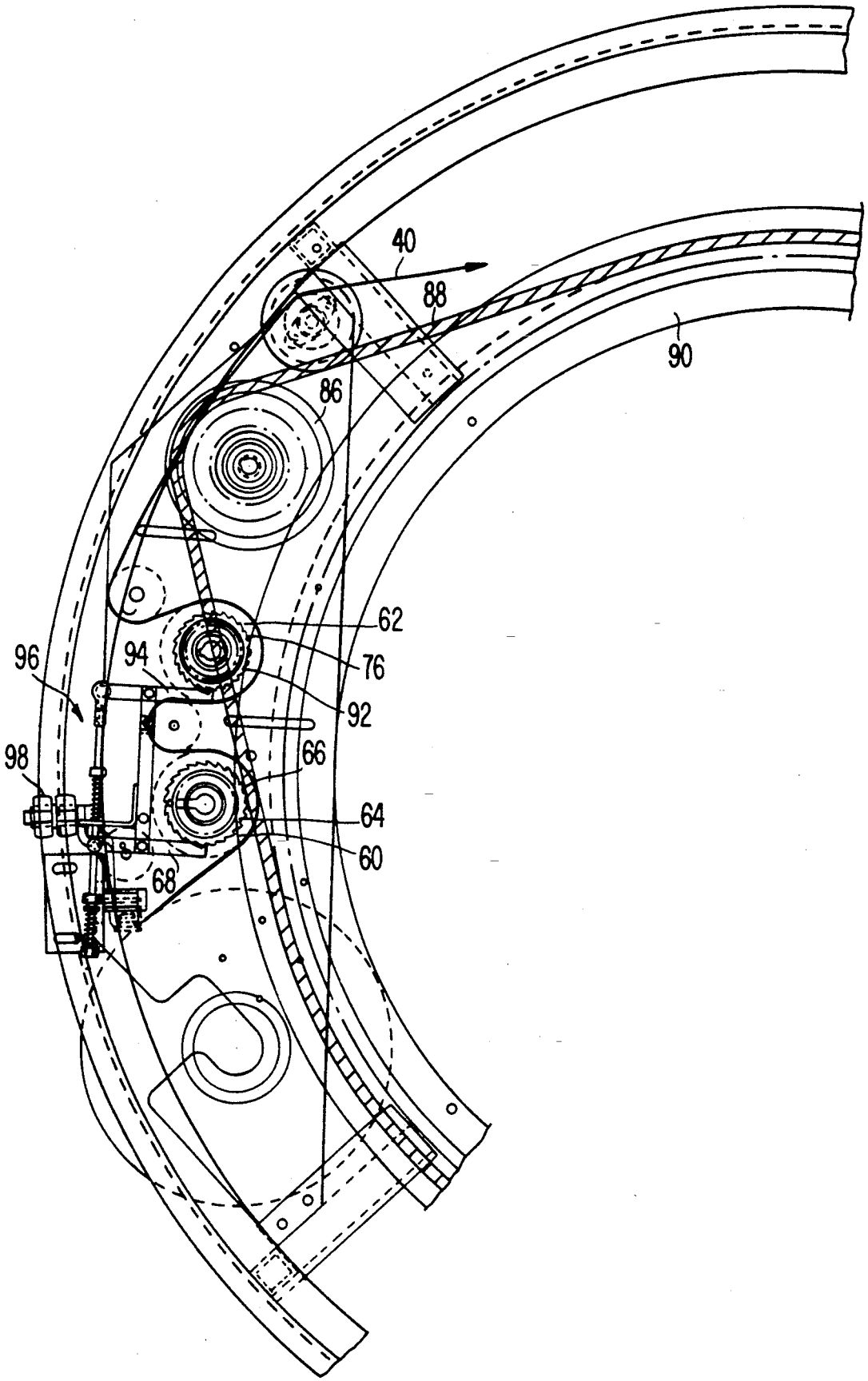
FIG. 3 is an expanded view of a portion of FIG. 2.
Figure 4:
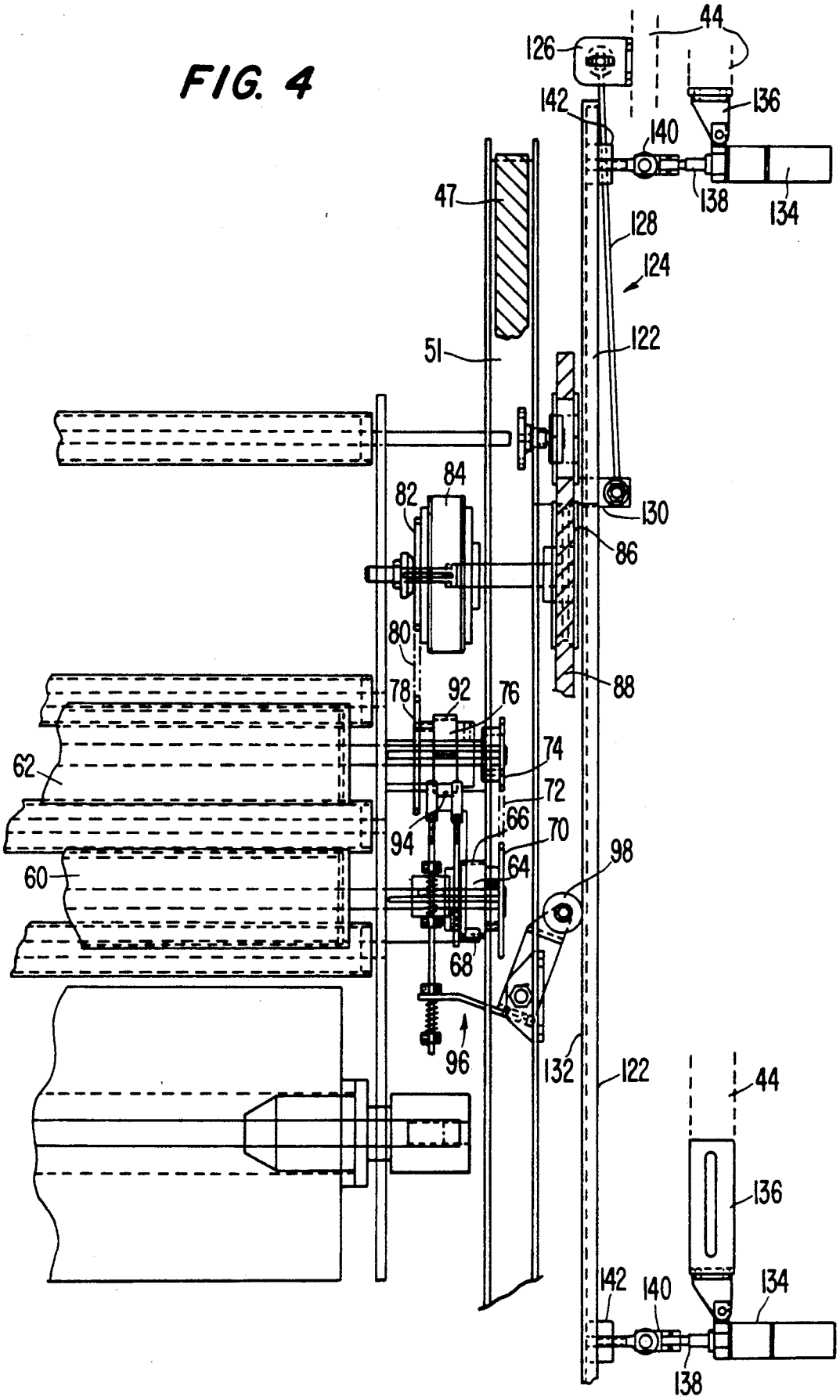
FIG. 4 is an expanded view of a portion of FIG. 1.

The tensioning system preferably includes upstream and downstream prestretch rollers which rotate at different speeds to dispense and stretch the web. As shown in FIGS. 3 and 4, the tensioning system in roll carriage 56 includes an upstream prestretch roller 60 and a downstream prestretch roller 62 which rotate at different speeds to dispense and stretch the film web 40. The downstream prestretch roller 62 rotates at a faster speed than upstream prestretch roller 60 so that the film is stretched between prestretch roller 60 and 62.

This speed differential can be obtained in a number of ways including mechanically connecting the prestretch rollers 60 and 62 with a chain and sprockets having a desired gear ratio. Various prestretch arrangements are illustrated and discussed in more detail in a number of the patents which are incorporated by reference. The present invention may also be incorporated into other prestretch arrangements.

As shown in FIGS. 3 and 4, a wrap spring clutch 64 is positioned coaxially with upstream prestretch roller 60 and is interposed in the mechanical drive between prestretch roller 60 and 62. A suitable wrap spring clutch 64 is manufactured by Warner, Model No. PS 1-6-SS-CW-HI-$\frac{3}{4}$ bore. It includes a ratchet collar 66 which is selectively engageable by a pawl 68 as shown in FIGS. 3 and 4. Alternatively, other clutch or engagement devices may be used.

When clutch 64 is engaged, the prestretch rollers 60 and 62 are interconnected to rotate at different surface speeds to dispense and stretch the web. When clutch 64 is disengaged, prestretch rollers 60 and 62 are not interconnected and rotate at similar surface speeds to dispense the web without stretching the web.

As shown in FIG. 4, sprocket 70 is connected to one side of clutch 64. The other side of clutch 64 is connected to prestretch roller 60. Sprocket 70 is connected by chain 72 to sprocket 74 which is connected to downstream roller 62. As shown in FIG. 3, to disengage the tension, the clutch pawl 68 is rotated into the ratchet collar 66.

The tensioning system also can include a brake which restrains the film roll as the web is dispensed. It also can include a roller between the film roll and the load which is connected to a brake. The present invention may be incorporated into these arrangements in the manner illustrated and described by using an arrangement which permits the brake to be engaged and released, or otherwise regulated.

The tensioning system also preferably includes at least one power assisted roller which is driven by a power source to decrease the tension on the web between the dispenser and the load. As shown in FIG. 4, the power assisted roller includes downstream prestretch roller 62. Downstream prestretch roller 62 is connected to sprocket 74 which is connected to one side of clutch 76. The other side of clutch 76 is connected to sprocket 78 which is connected through chain 80 to sprocket 82. Sprocket 82 is connected to the output side of a constant torque converter 84 such as those made by Warner as Model No. HC6-1.

The input of constant torque converter 84 is connected to a pulley 86 which is driven by a timing belt 88 which also engages a power source such as ring 90 as shown in FIG. 3. Ring 90 is shown to be stationary and is fixed to support frame 44. Alternatively, in some applications, ring 90 can be driven relative to support frame 44 and rotatable drum 46 to rotate pulley 86 to provide a different tensioning control. It is within the scope of the invention that the power source may take other forms as well.

Through the use of constant torque converter 84, the driving of pulley 86 results in a constant torque output on sprocket 82. This constant torque output is coupled to downstream prestretch roller 62 by clutch 76. Clutch 76 is a wrap spring clutch like clutch 64 and has a ratchet collar 92 which is engageable by a pawl 94. When the pawl 94 engages ratchet collar 92, downstream prestretch roller 62 is disengaged from constant torque converter 84. When pawl 94 is not engaged in ratchet collar 92, downstream prestretch roller 62 is engaged with the output of constant torque converter 84. In the usual case, this provides additional torque to downstream roller 62, thereby decreasing the amount of tension in the web between downstream prestretch roller 62 and the load 30.

It is within the scope of the invention that the power assisted roller, such as downstream prestretch roller 62, can be power assisted by a speed controlled power input rather than a torque or force controlled power input. It is also within the scope of the invention to have a drive having a plurality of power assist modes in place to provide alternative power source inputs such as a torque or force controlled input and a speed controlled input, two torque or force controlled inputs, or two speed controlled inputs.

Various torque or force controlled power inputs and speed controlled power inputs are illustrated and discussed in more detail in a number of the patents which are incorporated by reference. A torque or force controlled input would generally cause the film web to be dispensed at a constant tension between the dispenser and the load regardless of the speed at which it is dispensed. A speed controlled input would generally cause the same amount of film web to be dispensed for each revolution of the dispenser regardless of the tension on the film web between the dispenser and the load. For example, substituting the constant torque converter 84 with a gear box or similar transmission would result in a speed controlled input.

Having a plurality of power source inputs and having the ability to actuate one or more of them in an independent manner would permit a change in the tension on the film web or the manner in which the film web tension is applied. This change could be accomplished, for example, by engaging and disengaging additional clutches in a manner similar to the arrangement and operation of the clutches, drives and actuation devices described in relation to the illustrated embodiments.

Figure 6:
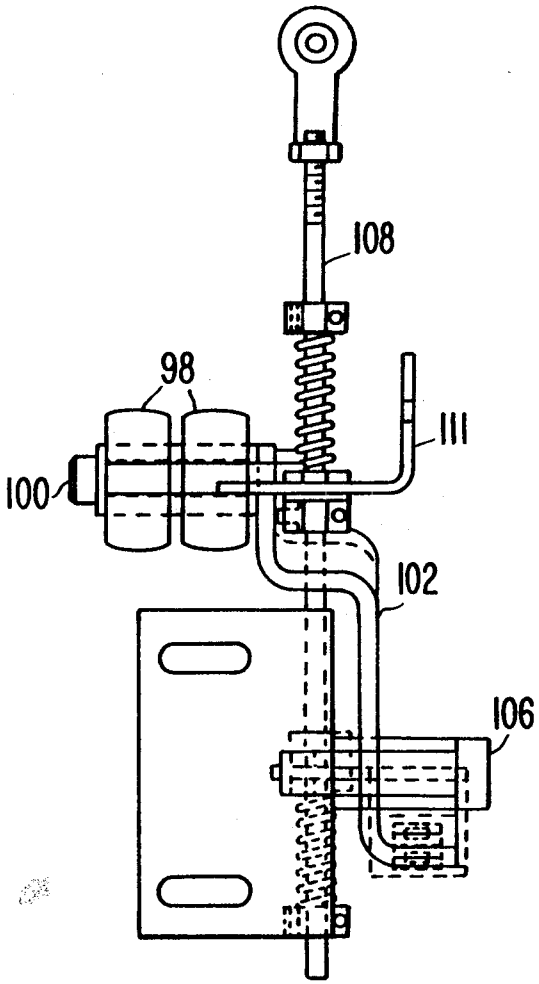
FIG. 6 is an end view of FIG. 5.
Figure 5:
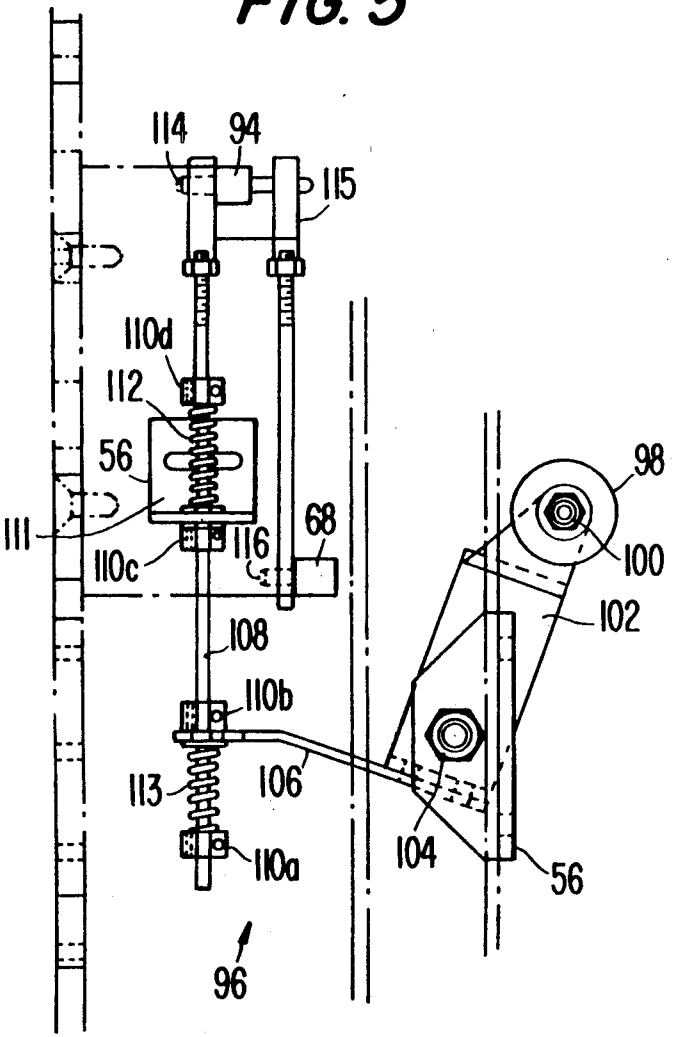
FIG. 5 is an expanded view of the portion of FIG. 4.

As shown in FIG. 2 the dispenser components in roll carriage 56 are supported by the rotatable drum 46 and the dispenser components follow an orbital path around the load as they are carried by rotatable drum 46. As shown in FIGS. 3 and 4, pawls 68 and 94 are engaged and disengaged from respective ratchet collars 66 and 92 by a linkage 96 which connects pawls 68 and 94 to rollers 98. Parts of the linkage 96 is shown in an expanded view in FIGS. 5 and 6. As shown in FIG. 5, rollers 98 rotate about an axle 100 which is supported in plate 102. Plate 102 pivots about axle 104 which is mounted on the roll carriage 56. Plate 102 is connected to arm 106. The other end of arm 106 slides rod 108, which pivots pawls 68 and 94 which are tied together by arm 115.

Collars 110 are fixed to rod 108 at various points along its length. Rod 108 is slidably mounted to roll carriage 56 by angled mount 111. A relatively weak spring 112 is positioned between collar **110*d* and mount 111. A relatively strong or stiff spring 113 is mounted between collar 110*a* and arm 106. The end of rod 108 is adjustably connected to an axle 114 which pivotally passes through the end of pawl 94 and one end of arm 115. The other end of arm 115 is connected to an axle 116 which is pivotally connected to one end of pawl 68**.

When roller 98 moves to the left, weak spring 112 will compress as rod 108 moves downward and pulls the end of pawls 94 and 68 along with it. When the other end of pawls 94 and 68 pivot about central axles to engage their respective ratchet collars, strong or stiff spring 113 begins to compress if roller 98 is moved farther to the left. Rods 108 and 115 are independently adjustable through the use of a two piece threaded construction.

Although the arrangement shown in these drawings moves both pawls 68 and 94 together, it is within the scope of the invention to move each pawl separately through independent linkages, to separately and independently engage and disengage the clutches. An illustration is shown in FIG. 8 where roller 98*a* is independently linked by linkage 96*a* to engage one clutch and roller 98*b* is independently linked by linkage 96*b* to independently engage a second clutch.

In accordance with the present invention, the tensioning system is operable in a plurality of tensioning states. As shown in the drawings, the web tensioning system of roll carriage 56, which includes the prestretch rollers 60 and 62 and the constant torque converter 84, are operable in a plurality of states or modes of tensioning operation.

In the embodiment shown, the tensioning system operates in one tensioning state when the clutches 64 and 76 are engaged. In this state, prestretch rollers 60 and 62 rotate at different speeds and prestretch the web 40, and the power assist through the constant torque converter 84 reduces the tension on the web 40 between downstream prestretch roller 62 and the load 30.

Another state of operation occurs when the pawls 68 and 94 engage ratchet collars 66 and 92 and disengage clutches 64 and 76. In this state, prestretch rollers 60 and 62 are allowed to freely rotate relative to each other without prestretching the web 40, and the power assist is removed from downstream roller 62.

Other states of operation for the web tensioning system are also within the scope of the invention. For example, a linkage may be used to permit the tensioning mechanism of the prestretch rollers 60 and 62, or the power assist from the constant torque converter 84 to be engaged independent of each other. In such an arrangement, at least three states of tensioning operation are possible because either, both or neither of the prestretch and power assist assemblies may be engaged.

Additional states of operation within the scope of the invention include a plurality of states of operation defined by several different amounts or types of power assist resulting from utilizing a plurality of torque controlled or speed controlled devices of which can be selectively engaged independently or in combination with each other. For example, a plurality of such devices can be employed in a manner similar to that illustrated by constant torque converter 84. It is possible that one or more of the tensioning states of operation of the web tensioning system involves the application of little or no tension to some or all of the web.

According to the present invention, there is at least one actuation ring movably mounted on the support frame for cooperation with the tensioning system and for selectively rendering the tensioning system operable in each of the plurality of states of operation throughout the orbital path of the dispenser.

As shown in FIGS. 1 and 2, the actuation ring includes actuation ring 122 which is coaxial with the rotatable drum 46 and the orbit of the roll carriage 56. Actuation ring 122 is supported on support frame 44 by support linkages 124. As shown in FIGS. 2 and 4, support linkages 124 include mounting plate 126 which is secured to support frame 44, support plates 128, and mounting plate 130. One end of plate 128 pivots in an oblong aperture in angled mounting plate 126. The other end of plate 128 pivots in mounting plate 130 which is attached to actuator ring 122.

The support linkages 124 support the weight of actuation ring 122 and permit it to swing so as to move in the axial direction. In FIG. 4, the axial direction is in the horizontal direction between right and left. As further shown in FIG. 4, actuation ring 122 has an L-shaped cross section and has an axial surface 132 against which rollers 98 are engageable. The movement of actuation ring 122 in the axial direction causes cooperation with rollers 98 of the tensioning system. Such movement of actuation ring 122 causes movement of rollers 98 in the axial direction, thereby moving linkage 96, engaging or disengaging pawls 68 and 94 from ratchet collars 66 and 92.

In accordance with the invention there may be provided a plurality of actuation rings which are independently moveable relative to each other for cooperating with a tensioning system independently of each other. As shown in FIG. 8, the plurality of actuation rings include coaxial nesting actuator rings 122*a* and 122*b* which are supported in the same manner as the embodiment of actuation ring 122 in FIGS. 1–4. Actuation rings 122*a* and 122*b* move independently and cooperate respectively with rollers 98*a* and 98*b* in the same manner as the embodiment shown in FIGS. 1–4.

According to the present invention, at least one activator is provided for moving the actuation ring to cooperate with the tensioning system. As shown in FIG. 4, the activator includes a set of air cylinders 134 which are pivotally secured to mounting plates 136 which are secured to frame 44. The pistons 138 of air cylinders 134 are connected by a universal joint 140 to a mounting plate 142 which is secured to actuation ring 122. Air cylinders 134 can be activated to move actuation ring 122 in the axial direction through the use of pressurized air which is controlled by a pneumatic solenoid valve which responds to a control signal. The control signal can be, for example, electrical or pneumatic.

The air cylinders 134 are preferably single acting air cylinders, such as Bimba Model 121-R, and are normally spring extended. For such cylinders, air is only applied to one side of the air cylinder piston, and when the air is applied to the cylinder, it causes the cylinder rod to retract. Without air in the cylinder, the cylinder rod extends itself and remains extended because it is spring loaded.

When the rods are extended, normally without any air or power to the system, they position the actuation ring 122 to the left in FIG. 4, moving rollers 98 which in turn engage the pawls into the ratchet collars of the clutches. The ring moves to the right in FIG. 4 when air actuates the cylinders. At that point, the rollers 98 and their spring loaded mechanism move to the right in FIG. 4. Preferably, in this position, the rollers do not touch the actuation ring any more. In this position, the pawls are pulled away from the wrap spring clutches and the tensioning system is actuated in the normal wrapping state or mode.

Air cylinders 134 can be said to move the actuation ring 122 between an actuating position and a non-actuating position. The actuating position is the position in which the actuation ring causes the web tensioning system to be engaged. Similarly, the non-actuating position is the position of the actuation ring when the web tensioning system is disengaged. Depending on the application, the actuating position can either be the position when air is applied to the cylinders to move the piston in one direction or when the piston is moved in the other direction by the spring force. Other activators such as linear actuators may also be used.

In accordance with the present invention, when there are a plurality of actuation rings, there also are preferably a plurality of actuators for respectively and independently moving the respective actuation rings to independently cooperate with the tensioning system. As shown in FIGS. 8, the plurality of actuators include a first set of air cylinders 134*a* and a second set of air cylinders 134*b*. First set of air cylinders 134*a* move actuator ring 122*a* and second set of air cylinders 134*b* move actuation ring 122*b*.

This system can be used for a number of applications. When threading the rollers in the dispenser, the access door to the machine can be opened which, because of a safety switch, drops power to the machine which cuts off the air pressure. Through the arrangement described above, this disengages the prestretch rollers which facilitates threading the rollers in the dispenser.

The system can also be used when sequencing a series of operations in an automatic cycle when reduced tension on the film web between the dispenser and the load is desired at certain points in the wrapping operation. The PLC can be programmed to provide the normal tension by sending a signal out which energizes a pneumatic solenoid valve which in turn allows air to the actuator cylinders for the actuation ring. By sending air to the actuator, it retracts the actuation ring and the pawls are pulled away from the wrap spring clutches. The clutches then fully engage to provide for prestretch and/or power assisted drive of the film web.

Reduced tension can be employed at the end of a cycle by programming the PLC to not send a signal to the pneumatic solenoid valves, thereby deenergizing the air cylinders and allowing the actuation ring to extend. The extension engages the linkage to the pawls, pushing the pawls back into the wrap spring clutches and reducing the tension in the web between the dispenser and the load. This can also result in unstretched film in the clamp and wipe down operations, which is desirable in some applications.

Photo cells are employed to sense film breaks. In such instances, the signal to the pneumatic solenoid valves is stopped and the actuator ring will be allowed to extend and engage the mechanism which pushes the pawls into engagement with the wrap spring clutch. This disengages the power assist and the prestretch to prevent the film from wrapping on the prestretch rollers.

The system also works in an emergency stop condition where power is either intentionally or unintentionally lost. Such condition prevents a signal from going to the solenoid valve and disengages the prestretch rollers and the power assist.

The system allows engagement or disengagement at any point and at any time during the movement of the film web dispenser and also at any point when the film web dispenser is not moving.

It will be apparent to those skilled in the art that various modifications and variations can be made in the wrapping machine of the present invention without departing from the scope or spirit of the invention. It is intended that the specification and examples be considered as exemplary, with the scope and spirit of the invention being indicated by the following claims and their equivalents.

What is claimed is:

1. An apparatus for stretch wrapping a load with a web of packaging material, the apparatus comprising:

a support frame;

a rotatable frame rotatably mounted on the support frame;

a dispenser mounted on the rotatable frame to travel along an orbital path as the rotatable frame is rotated, the dispenser having a web tensioning system which is selectively operable in a plurality of different web tensioning operation states;

at least one actuation ring movably mounted on the support frame and configured to operatively interact with the web tensioning system throughout the travel of the dispenser along the orbital path to selectively operate the web tensioning system in each of the plurality of different web tensioning operation states; and at least one activator for moving the actuation ring to selectively operate the web tensioning system in each of the different web tensioning operation states throughout the travel of the dispenser along the orbital path.

2. The apparatus of claim 1, wherein said at least one actuation ring includes a plurality of actuation rings independently moveable relative to each other, each of the plurality of actuation rings configured to operatively interact with the web tensioning system throughout the travel of the dispenser along the orbital path to independently and selectively operate the web tensioning system in a respective one of each of the plurality of different web tensioning operation states; and further wherein said at least one activator includes a plurality of independent activators corresponding with the plurality of actuation rings for respectively and independently moving the corresponding actuation rings to selectively operate the web tensioning system in each of the plurality of different web tensioning operation states throughout the travel of the dispenser along the orbital path.

3. The apparatus of claim 1, wherein the web tensioning system includes upstream and downstream prestretch rollers operable in a state in which the upstream and downstream rollers rotate at different speeds relative to each other to dispense and stretch the web, and in a state in which the upstream and downstream rollers rotate at similar speeds to dispense the web without stretching the web.

4. The apparatus of claim 1, wherein the web tensioning system includes at least one power assisted roller which is engageable with a power source to be operable in a state in which the at least one power assisted roller is engaged with the power source to decrease web tension between the dispenser and the load, and in a state in which the at least one power assisted roller is disengaged from the power source.

5. The apparatus of claim 1, wherein the web tensioning system includes upstream and downstream prestretch rollers operable in a state in which the upstream and downstream prestretch rollers rotate at different speeds relative to each other to dispense and stretch the web, and in a state in which the upstream and downstream prestretch rollers rotate at similar speeds to dispense the web without stretching the web; and wherein the web tensioning system includes at least one power assisted roller which is engageable with a power source to be operable in a state in which the at least one power assisted roller is engaged with the power source to decrease web tension between the dispenser and the load, and in a state in which the at least one power assisted roller is disengaged from the power source.

6. The apparatus of claim 1, wherein the at least one actuation ring has an axial direction, and further wherein the actuation ring operatively interacts with the web tensioning system by movement of the actuation ring in the axial direction.

7. The apparatus of claim 1, wherein the web tensioning system includes at least one power assisted roller and a drive having a plurality of power assist modes to enable the operation of at least one of the plurality of different web tensioning operation states for the web tensioning system.

8. The apparatus of claim 7, wherein the drive having a plurality of power assist modes includes a force control mode for controlling tension force of the web and a speed control mode for controlling dispensing speed of the web.

9. The apparatus of claim 8, wherein the drive having a plurality of power assist modes includes at least two force control modes for controlling tension force of the web, each of the at lest two force control modes providing operation at different respective force levels.

10. The apparatus of claim 8, wherein the drive having a plurality of power assist modes includes at least two speed control modes for controlling dispensing speed of the web, each of the at least two speed control modes providing operation at different respective speeds.

11. An apparatus for stretch wrapping a load with a web of packaging material, the apparatus comprising:

a support frame;

an actuation ring moveably mounted on the support frame;

an activator for moving the actuation ring between an actuating position and a non-actuating position;

a rotatable frame rotatably mounted on the support frame; and a dispenser mounted on the rotatable frame to travel along an orbital path as the rotatable frame is rotated, the dispenser having a web tensioning system which is selectively engageable for and disengageable from tensioning operation throughout the travel of the dispenser along the orbital path by movement of the actuation ring, wherein the actuation ring is configured to operatively interact with the web tensioning system so that the web tensioning system is engaged for tensioning operation when the actuation ring is in the actuating position, and the web tensioning system is disengaged from tensioning operation when the actuation ring is in the non-actuating position, wherein the activator includes means for moving the actuation ring between the actuating and non-actuating positions throughout the travel of the dispenser along the orbital path.

12. The apparatus of claim 11, wherein the web tensioning system includes upstream and downstream prestretch rollers which rotate at different speeds relative to each other to dispense and stretch the web when the actuation ring is in the actuating position and the web tensioning system is engaged for tensioning operation, and which rotate at similar speeds to dispense the web without stretching the web when the actuation ring is in the non-actuating position and the web tensioning system is disengaged from tensioning operation.

13. The apparatus of claim 11, wherein the web tensioning system includes a roller which is engageable with the actuation ring.

14. The apparatus of claim 11, wherein the web tensioning system includes a surface which is engageable with an axial surface of the actuation ring.

15. The apparatus of claim 11, wherein the web tensioning system includes a roller which is engageable with an axial surface of the actuation ring.

16. The apparatus of claim 11, wherein the actuation ring has an axial direction, and further wherein the actuating position and the non-actuating position of the actuation ring are spaced from each other in the axial direction.

17. The apparatus of claim 11, wherein the web tensioning system includes at least one power assisted roller which is driven by a power source to decrease web tension between the dispenser and the load when the actuation ring is in the actuating position and the tensioning system is engaged for tensioning operation, and which is disengaged from the power source when the actuation ring is in the non-actuating position and the web tensioning system is disengaged from tensioning operation.

18. The apparatus of claim 17, wherein the power assisted roller is driven by the power source through rotation of the rotatable frame relative to the power source.

19. The apparatus of claim 11, wherein the web tensioning system includes upstream and downstream prestretch rollers which rotate at different speeds relative to each other to dispense and stretch the web when the actuation ring is in the actuating position and the web tensioning system is engaged for tensioning operation, and which rotate at similar speeds to dispense the web without stretching the web when the actuation ring is in the non-actuating position and the tensioning system is disengaged from tensioning operation; and further wherein the web tensioning system includes at lest one power assisted roller which is driven by a power source to decrease web tension between the dispenser and the load when the actuation ring is in the actuating position and the web tensioning system is engaged for tensioning operation, and which is disengaged from the power source when the actuation ring is in the non-actuating position and the tensioning system is disengaged from tensioning operation.

20. The apparatus of claim 19, wherein the web tensioning system dispenses the web of packaging material in a relatively tensioned state between the dispenser and the load when the actuation ring is in the actuated position, and in a relatively untensioned state between the dispenser and the load when the actuation ring is in the non-actuated position.

* * * * *

UNITED STATES PATENT AND TRADEMARK OFFICE

CERTIFICATE OF CORRECTION

PATENT NO. : 5,311,725
DATED : May 17, 1994
INVENTOR(S) : Martin et al.

It is certified that error appears in the above-indentified patent and that said Letters Patent is hereby corrected as shown below:

Claim 19, col. 12, line 45, change "lest" to --least--.

Signed and Sealed this

First Day of November, 1994

Bruce Lehman

*Attest:*

BRUCE LEHMAN

*Attesting Officer*

*Commissioner of Patents and Trademarks*